US005433686A

United States Patent [19]

Marsh

[11] Patent Number: 5,433,686

[45] Date of Patent: Jul. 18, 1995

[54] DEVICE FOR USE IN SAFELY OFF-LOADING BARBELL WHICH LIFTER CANNOT RETURN TO OVERHEAD CRADLE OF BENCH PRESS STAND

[75] Inventor: Lawrence E. Marsh, Thatcher, Ariz.

[73] Assignee: Bench Press Escape, Inc., Thatcher, Ariz.

[21] Appl. No.: 205,079

[22] Filed: Mar. 3, 1994

[51] Int. Cl.[6] ..... A63B 21/078

[52] U.S. Cl. ..... 482/104

[58] Field of Search ..... 482/92–94, 482/97, 109, 106, 108, 148; 224/158, 150; 248/300; 414/745.1

[56] References Cited

U.S. PATENT DOCUMENTS

| | | | |
|---|---|---|---|
| 4,231,570 | 11/1980 | Reis | 482/104 |
| 4,411,425 | 10/1983 | Milnar | 482/104 |
| 4,757,998 | 7/1988 | Landin | 482/104 |

*Primary Examiner*—Richard J. Apley
*Assistant Examiner*—John Mulcahy
*Attorney, Agent, or Firm*—Cushman Darby & Cushman

[57] ABSTRACT

An emergency accessory for use by a lifter in extrication from under the bar of a barbell which he or she is bench pressing and, due to injury, fatigue or inconsequence of excessive optimism cannot, without assistance, raise to deliver to the cradle of the bench press stand. The accessory includes a bent sheet metal weight-distribution ramp having a broad upper panel integrally joined at an obtuse-angle transverse bend, to a tapering lower panel which terminates in a padded support pedestal for engagement of the bench press stand between the lifter's legs. In use, the lifter lowers the bar to rest on the main panel, rolls or slides the bar to the bend (which is juxtaposed upon near the lifter's waist), causing the ramp to rotate about the bend, until its support pedestal centrally engages the upper surface of the stand, then sit up. The barbell's weight thereby having been transferred largely to the stand, the lifter is free to escape rearwards towards the head of the bench press stand.

11 Claims, 4 Drawing Sheets

DEVICE FOR USE IN SAFELY OFF-LOADING BARBELL WHICH LIFTER CANNOT RETURN TO OVERHEAD CRADLE OF BENCH PRESS STAND

BACKGROUND OF THE INVENTION

In performing a supine press, a lifter, who has assumed a supine position on a bench press stand, grasps the bar of a barbell supported in the overhead cradle of the stand, and, with elbows extended or alongside the body, presses straight up. After the barbell has been pressed overhead until the arms are completely extended, the barbell is lowered back onto the cradle, or down to the chest. If the barbell is lowered to the chest, raising it again from that position is termed a two-arm bench press.

Usually, a lifter works with a spotter, i.e., in a buddy system together with another person who is capable of relieving the lifter of the barbell or assisting the lifter in returning the bar to the cradle when, through injury, fatigue brought on by the number of bench press repetitions, or excess of optimism as to the amount of weight that the lifter can bench press from a supine position, the lifter unassisted is not at the moment capable of escaping unassisted from under.

Because sometimes a lifter, despite being aware of the risk, practices bench pressing, at least occasionally, without a spotter, or with a spotter who has become temporarily distracted with doing something else, the lifter becomes stuck with a barbell that they can no longer return to the cradle, the occasion for injury and/or damage exists. Others have attempted to solve this problem in many ways, mostly by providing variously shaped and positioned accessories mounted at the sides to the bench press stand. Typical prior art proposals include a lower cradle located on the stand at mid-chest, or similarly located ramps.

Stand-mounted assisting devices of the prior art tend to be bench-specific, i.e., they are made to be used only on a specific bench press stand, and may require modifications to be made to the stand, such as drilling holes in its frame members, possibly to the detriment of the structural integrity of the stand. With most of these designs, it is an assumption that the lifter gets in trouble when the barbell has a narrow range of location; using them, there is no way for a lifter to extricate their stomach, pelvic and/or thigh areas from under the barbell bar.

Also, the fact that the bench-mounted extrication facilitating devices are located where they are, can cause them to interfere with desired full downward extension of the lifter's arms as the barbell bar is lowered just below contact with the chest as should occur in routine bench pressing repetitions. Use of these prior art devices also may necessitate that the lifter pause to regain sufficient strength, before extricating theirself by doing some work against gravity, meanwhile fighting off the natural tendencies to panic or despair.

The bulkiness of the bench-mounted prior art devices no doubt contributes to their expense, and tends to cause them to lack portability. It is not really feasible for a lifter to pack one in a workout tote bag and take it along for their own temporary use at a training facility which is also used by others and does not already have an extrication facilitating device.

SUMMARY OF THE INVENTION

An emergency accessory for use by a lifter in extrication from under the bar of a barbell which he or she is bench pressing and, due to injury, fatigue or inconsequence of excessive optimism cannot, without assistance, raise to deliver to the cradle of the bench press stand. The accessory includes a bent sheet metal weight-distribution ramp having a broad upper panel integrally joined at an obtuse-angle transverse bend, to a tapering lower panel which terminates in a padded support pedestal for engagement of the bench press stand between the lifter's legs. In use, the lifter lowers the bar to rest on the main panel, rolls or slides the bar to the bend (which is juxtaposed upon near the lifter's waist), causing the ramp to rotate about the bend, until its support pedestal centrally engages the upper surface of the stand, then sits up. The barbell's weight thereby having been transferred largely to the stand, the lifter is free to escape rearwards towards the head of the bench press stand.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figures 1, 2:
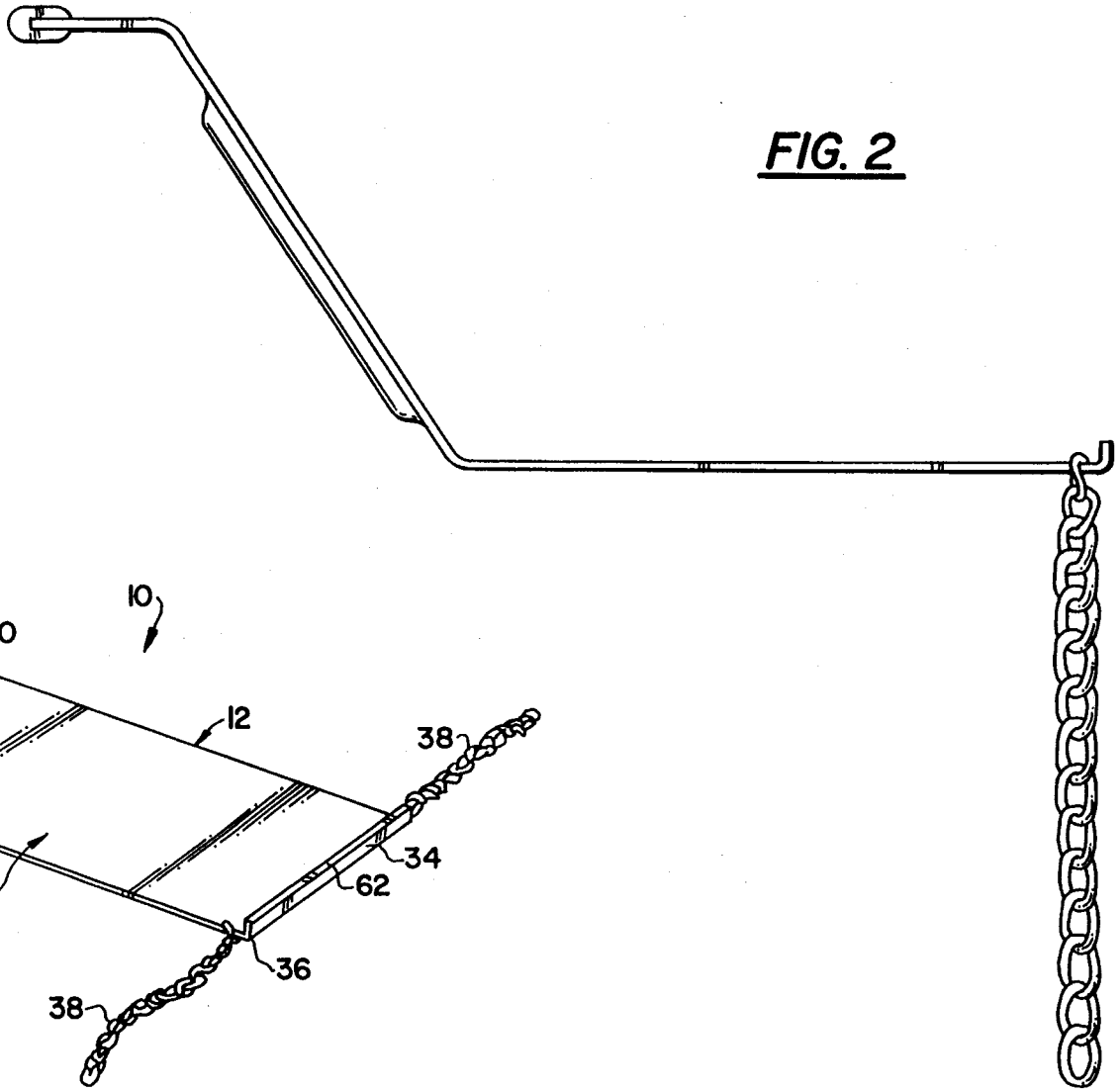
FIG. 1 is a perspective view of a presently preferred embodiment of a bench press lifter's emergency barbell-extrication device provided in accordance with principles of the present invention.
FIG. 2 is a side elevational view thereof.

A device 10 is preferably principally made of a plate or sheet of cut or stamped and bent sheet metal. Its size, thickness, shape, proportions, constituency and finish all are subject to some variability, depending on who is going to use it, its duty and what the potential user is prepared to invest in it. The embodiment which is depicted is generally useful by a wide range of average adult lifters. A smaller size can be made, for instance, to serve juvenile and notably small adults. Similarly, a larger size can be made to serve particularly large or broad-chested lifters expecting to handle notably heavy barbells. The quantifications given further below in this description are for the current best mode of the preferred embodiment that is believed to be suited for use by most lifters.

The principal component of the device 10 as shown, is a weight-distribution ramp member 12 that most conveniently is constituted by a plate or sheet 12 of cut or stamped and bent sheet metal. It is shown having two main panels, namely a broad, preferably generally rectangular upper panel 14, which adjoins a laterally tapering lower panel 16 at a central transverse bend 18. The bend 18 provides an obtuse angle 20 between the front surfaces 22 and 24 of the panels 14 and 16.

The weight-distribution ramp member 12 is further shown including at its lower, narrower end 26, a support standard 28 which angles rearward at least generally in parallel to the plane of the upper panel 14 and terminates in a foot 30 at its free end. In the preferred embodiment which is shown, the support standard 28 is integrally provided with the lower panel 16, by the provision in the plate or sheet 12 of a second transverse bend 32 at the lower panel lower end 26.

Lastly, the weight-distribution ramp member 12 is shown preferably including an upper end flange 34 which projects forwards as a lip from a third transverse bend 36, provided at the upper end of the upper panel 14.

(In a device of the type shown, designations of parts with reference to some particular spatial orientation is necessarily somewhat unprecise, if not arbitrary. The conventions that are being used in this description, are that the face of the member 12, which, in use, is disposed towards the user, is its rear, and that its end, which, in use, is located nearest the user's head is its upper end. Thus, the lower panel 16 projects forwards from the plane of the upper panel 14 at the transverse bend 18, the lip 34 projects forwards at the transverse bend 36 and the standard or pedestal 28 projects rearwards at the bend 32. The "plane" of a panel, notionally, is the plane of either of its faces or the plane that the panel would exist in if it were infinitely thin. The left and right edges of the member 12 are its lateral, side or longitudinal edges. The longitudinal axis of the device, notionally, is a medial line running from top to bottom along the planes of the member 12.)

The device 10 is shown including as preferred elaborations, a set of positioning chains 38 and a shoe grommet 40.

The positioning chains 38 are shown being a pair of elongated flexible elements, preferably metal chains, each having one end secured (e.g., by having an end link or a 1⅛ inches S-hook looped through a hole, or by being spot welded) to the member 12 at a respective side edge of the member, e.g., at or near where the lip 34 joins the upper panel 14 at the bend 32.

In use, the chains hang down beside the left and right of the lifter's chest and so help the lifter to correctly centrally position the upper end of the device in a left-to-right sense on their torso.

The shoe grommet 40 is an edge protector or pad, preferably made of the same type of rubber as is used for providing edge strips for automotive door edge protectors and a finishing and protective edges for other plate-shaped members. Its two main purposes are to soften and fatten the free edge of the foot 30, and thereby, reduce the chance of its concentrating too much weight, at an edge, onto a person or onto the padded cover of the bench press stand 42.

The device 10 not only can be used by a wide variety of people, it can be used in conjunction with a wide variety of barbells and bench press stands 42. (Colloquially, a bench press stand is often referred to as being a "bench"; the term "bench press stand" is used herein because it is understandable, and avoids the awkwardness of using "bench press bench".)

The typical bench press stand 42 is shown including a legged frame 44, which, towards the head end, extends upwards to provide the left and right, upwardly opening yokes 46 of a cradle 48. The stand 42 further includes a usually padded, upholstered, generally horizontal support board 50 which is securely mounted on the frame 44. The padding (not shown) on the upper side of the board 50 usually is covered by durable and easily cleaned, non-absorbent upholstery fabric such as leather or (more typically) artificial leather, e.g., scrim fabric-reinforced vinyl plastic sheeting.

Typically, a barbell 52 includes a metal bar 54, having one or more annular disk weights 56 securely (and, usually, removably) mounted at each end, e.g., using securement collars 58, arranged in sets such that the barbell is equally heavy about the midpoint of the bar 54. The bar 54 is sufficiently long, and the weights 56 on its left and right ends are located sufficiently far apart, that, in use, the bar 54, when centered left to right, can be supported in the cradle 48 of the frame 44, with the respective sets of weights located adjacent but outbound of the respective cradle yokes 46.

In the preferred embodiment, the weight distribution ramp member may be made of anodized 5052 aluminum alloy 0.125 inch thick. It could be made of the same material and by the same process as is conventionally used in the manufacture of the side linkage elements of the mechanisms for recliner chairs. In large production runs, it can be stamped or sheared, drilled, bent, pressed and painted using automated equipment such as that used in the manufacture of recliner chair mechanisms. For smaller runs, these manufacturing steps can be performed using less highly automated equipment, such as that used in custom naval equipment cabinet making.

Some typical dimensions are provided below:

| | |
|---|---|
| width of upper panel | 8.0 inches |
| width of upper lip | 8.0 inches |
| length of upper panel | 11.75 inches |
| length of lower panel | 10.25 inches |
| width of lower panel at lower end | 4.875 inches |
| width of foot at lower end | 4.0 inches |
| height of lip | 0.50 inch |
| length of foot | 2.50 inches |
| radius of panel-to-panel bend | 0.50 inch |
| radius of lower panel-to-foot bend | 0.50 inch |
| radius of upper panel-to-upper lip bend | 0.125 inch |
| front-to-back thickness of shoe grommet | 0.5 inch |
| top-to-bottom height of shoe grommet | 1.0 inch |
| length of each positioning chain | 12.0 inches |

The device, as described above, is known to be useful by a 190-pound experienced male adult lifter of average height lifting a 180-pound barbell. It is believed to be suitable for a 110 to 200-pound novice-to-experienced male or female lifter bench pressing a 50 to 230-pound barbell from supine position from a conventional bench press stand.

The present inventor is a strong advocate of the habitual use of spotters by bench press lifters, and advocates use of the device of the present invention principally, if not exclusively, for nontypical, occasional and emergency situations where bench press lifting for some reason is going to be practiced, despite the risk, without a spotter, or while the spotter is temporarily absent or is otherwise distracted or not fully capable of rescuing a lifter from under a barbell that has become too heavy for the lifter to raise back into and deposit in the usual cradle. The present inventor is not at all equivocal in recommending the habitual use of spotters by bench pressing lifters.

Figure 3:
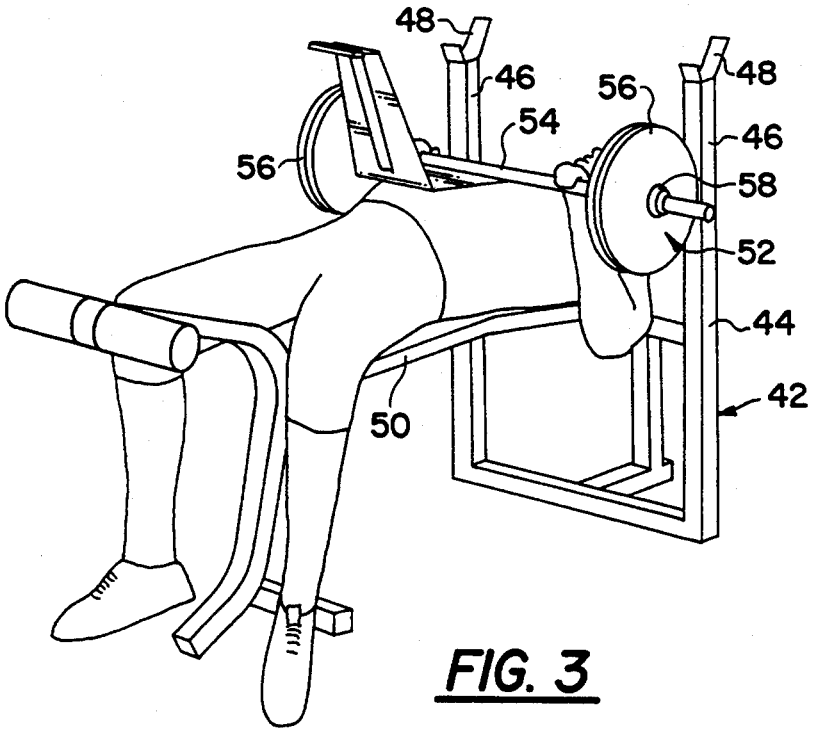
FIGS. 3–8 are a set of perspective views showing stages in use of the device by a lifter for extrication from a barbell.

Referring now more particularly to FIGS. 3–8 in succession, and first to FIG. 3, let us assume that the lifter has assumed a supine position, face up, on the bench, with his head near the head end of the bench. His thighs are spread, so that his legs below his knees hang down to the left and right of the bench near the foot end of the bench (which may mount usual accessory equipment, as shown). The lifter, with his hands far apart, has gripped the bar of the barbell and lifted the barbell from its cradle. Now, having repeatedly extended and retracted his arms and, thereby, raised and lowered the barbell over his chest, to exhaustion, he temporarily feels too weakened by the experience to once again raise the barbell sufficiently to maneuver it over and deposit its bar in the cradle of the bench. If his spotter were absent, distracted or incapable, and, if the lifter were not equipped with the device 10 of the present invention, the lifter would be about to undergo a harrowing or frightening, likely painful and perhaps dangerous and damaging experience, that of uncontrolled lowering of the barbell onto the person and perhaps uncontrolled bruising, rolling, bouncing and banging by the barbell.

However, the lifter of FIG. 3 is about to avoid such trauma, because he has had the forethought to become equipped with a device 10 for use in such an emergency.

In the instance depicted, before the lifter initially lifted the barbell from the cradle, he positioned the device 10 on his torso as shown. The undersurface of the upper panel rested on his chest, with the longitudinal centerline of the device substantially coinciding with the centerline plane of his body. He was aided in placement of the device by his making sure that the bend 18 was near where he would bend at the waist if he sat up, and that the chains hung down to about equal distance from the support board of the bench on both sides. His legs were sufficiently apart to accommodate engagement of the support board by the foot of the pedestal upon rotation of the device about the bend 18.

In FIG. 3, the lifter, realizing he has performed repetitions to exhaustion, has lowered the bar of the barbell onto the upper panel 14 of the device 10, on his chest. There is a wide variation in location of where he would lower the barbell and yet attain that objective. Now, depending on the weight of the barbell, he feels more or less uncomfortable, but he does not feel panicky or in danger. He has not been bruised and his ribs are not broken and his airway is not collapsed. He has reached a state of at least temporary stability. The stiffness of the panel 14, combined with its breadth and location on his body has spread out the weight of the barbell far more than would have been the case had all of its weight been transmitted to him via the bar resting directly on his chest.

Figure 4:
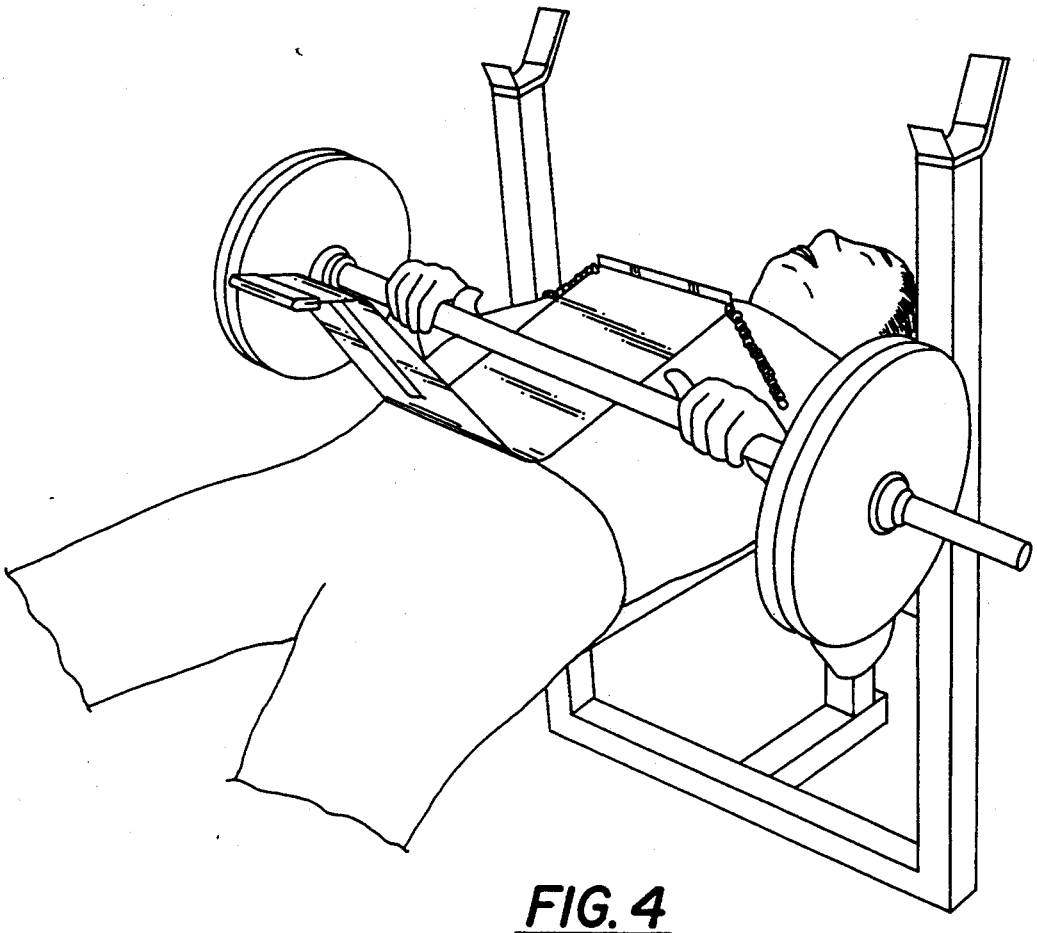
Figure 5:
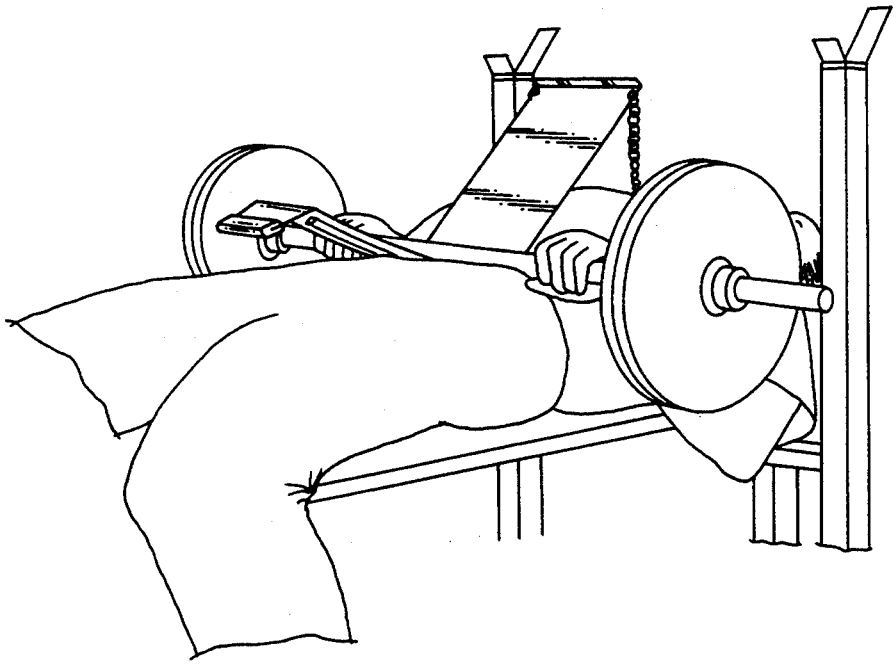

Having recovered some of his composure, if not his strength, the user, still gripping the barbell bar with both hands, slides it towards the bend 18 (FIG. 4). When it reaches the bend 18, and slightly beyond onto the lower panel 16, the device 10 begins to rotate about the bend 18 (FIG. 5, FIG. 6), so that the foot on the free end of the pedestal comes to engage the padded upholstered support board of the bench, between the user's legs. That transition also transfers much of the weight of the barbell to the bench, allowing the user then to sit up and, placing his chest against the rear of the upper panel 14 and his feet on the floor to each side of the bench partially arise and push himself backwards (FIG. 7), until he is utterly free of the barbell and can step away from the bench or sit back down at the head of the bench (FIG. 8), breath a sigh of relief and contemplate his experience. The height of the foot 30 relative to the bend 18 as the device 10 rests on the bench, has caused the barbell to assume a stable position, cradled in the bend 18.

It should be said that, during routine use, the weight of the chains 38 overcompensates for the cantilevered weight of the elevated lower part of the device (i.e., of the lower panel and support pedestal in the FIG. 3 position) and thereby helps to maintain the upper panel 14 in proper position against the user's chest despite vigorous movement by the user while exercising.

Figure 6:
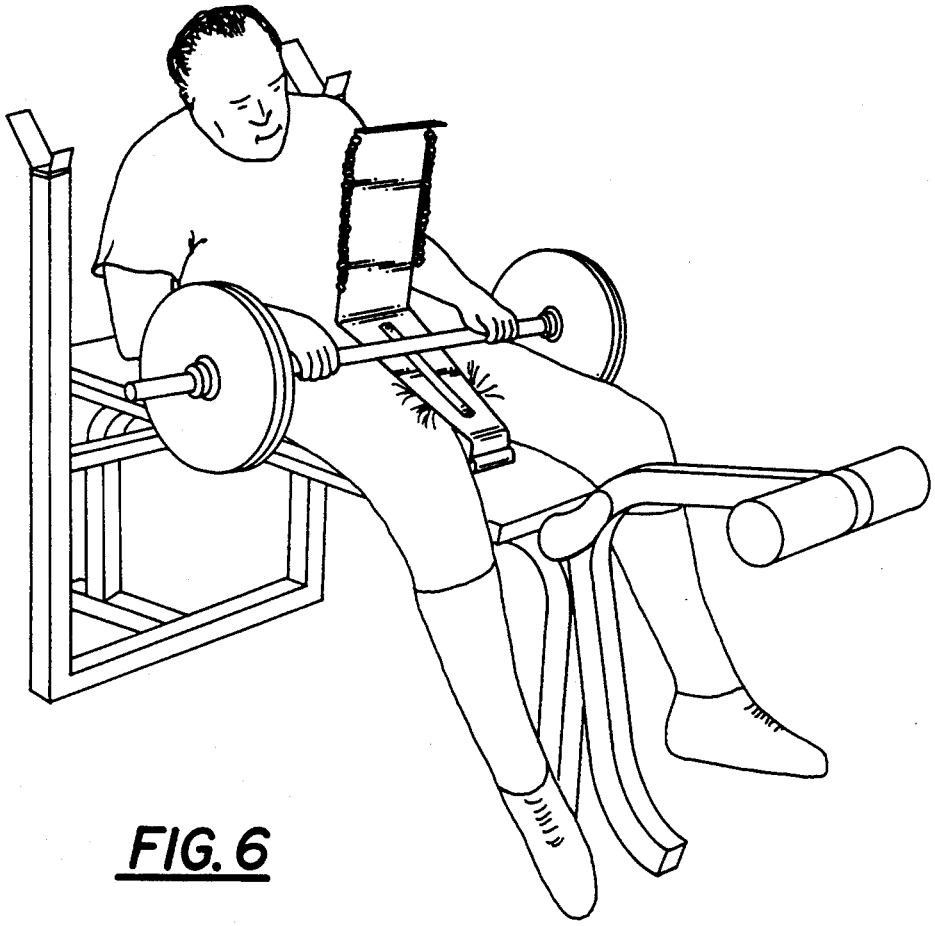
Figure 7:
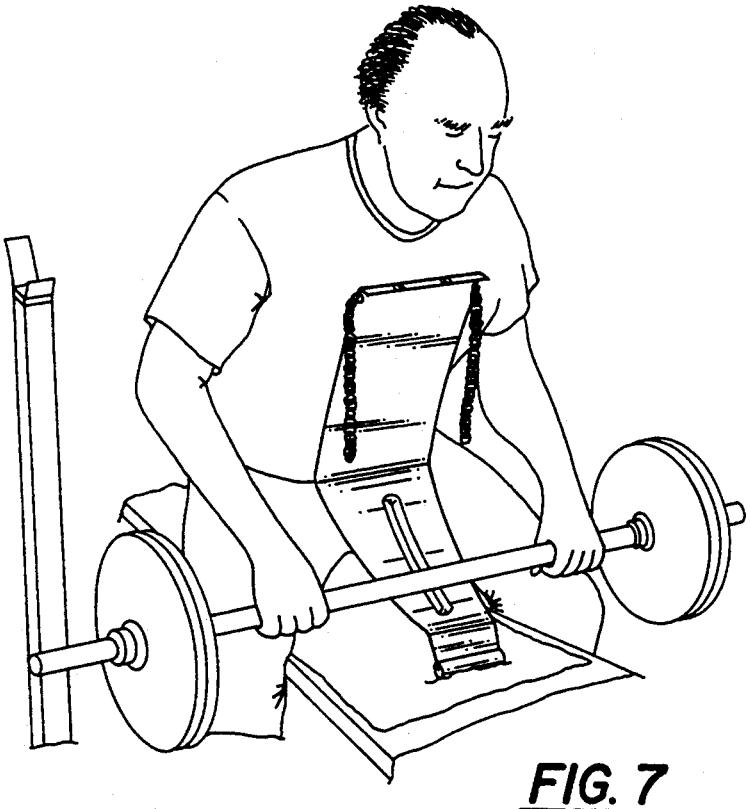
Figure 8:
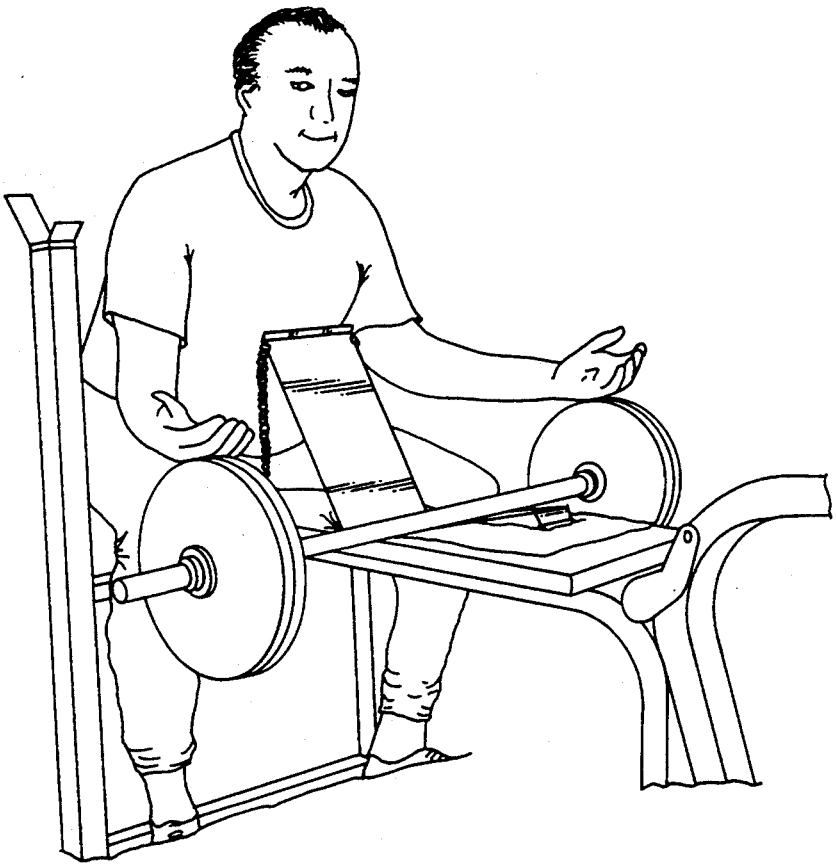

Any tendency of the lower panel 16 to excessively flex, or even to permanently bend during its use in the FIGS. 6 and 7 positions, can be overcome by providing that panel with one or more strengthening longitudinal ribs 60, either (most preferably) as pressed-in features, or as applied skeletal features (e.g., welded on bars), during manufacture of the device. By preference, one centered pressed rib 60 that is 6.5 inches long and 1.0 inch wide, of V-shaped profile, is provided.

The existence of the upper lip prevents a raw edge of the member 12 from facing the user, potentially forms a curb to prevent the barbell bar from rolling towards the neck of the user, and can provide a location for a centering mark 62 so that the user has another way of ensuring that the device is properly centered in the left-to-right sense for use.

The effective length of the pedestal, including the padded foot, is sufficient to prevent excessive weight on the user's groin and thighs as the device is being used in its FIGS. 6 and 7 positions.

The device 10 preferably is sufficiently lightweight, compact and portable as to be able to be transported and stored in a lifter's tote bag.

Of course, the four corners and all the edges of the plate 12 are rounded off and deburred, in order to minimize the chances for injury.

It should now be apparent that the device for use in safely off-loading barbell which lifter cannot return to overhead cradle of bench press stand as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A freeweight safety device for use in safely off-loading a barbell which a supine, bench-pressing lifter on the support board of a bench press stand is unable to return to the overhead cradle of the bench press stand, comprising:

an upper panel arranged to be supported generally horizontally and centrally in a left-to-right sense on a lifter's chest while the lifter is bench pressing a barbell using both hands, the upper panel being sufficiently stiff and of a sufficient size that, were the user to rest a barbell on the user's chest, the barbell's weight would be more evenly spread out over the user's torso than if the user were to rest the barbell directly on their chest;

a lower panel connected along an upper end thereof to a lower end of said upper panel so that the lower panel extends at a desired obtuse frontal angle to the upper panel, about a first transverse, horizontal bend axis; and a support pedestal connected at one end to the lower panel distally of said upper end of said lower panel said lower panel being of sufficient length as to extend across a lifter's groin area, centered in a left-to-right sense relative to said lower panel, and projecting rearwards at an obtuse angle to said lower panel; said support pedestal being of sufficient length as to engage the support board of a bench press stand, between a lifter's thighs, upon rotation of the device about said bend axis as a barbell, while resting on the upper panel, is progressively urged to proximity with said bend axis and beyond, onto said lower panel.

2. The device of claim 1, wherein:

said lower panel is fixedly integral with said upper panel along said first transverse bend.

3. The device of claim 2, wherein:

said support pedestal is fixedly integral with said lower panel along a second transverse bend.

4. The device of claim 3, wherein:

said lower panel tapers in width from said first transverse bend towards said second transverse bend.

5. The device of claim 4, wherein:

said upper and lower panels and said support pedestal are provided on respective regions of a bent metal plate.

6. The device of claim 5, wherein:

said lower panel includes at least one impressed longitudinal stiffening rib.

7. The device of claim 5, further including a shoe grommet, thicker than said plate secured on a free lower end of said support pedestal.

8. The device of claim 5, wherein:

said upper panel is generally rectangular and has an upper end.

9. The device of claim 8, further including an upturned lip flange formed on said upper end of said upper panel.

10. The device of claim 8, further including:

equal-length, left and right, elongated, flexible combined counterbalance and locate elements secured to said bent metal plate at respective sites near said upper end of said upper panel.

11. A method for use in safely off-loading a barbell which a supine, bench-pressing lifter on the support board of a bench press stand is unable to return to the overhead cradle of the bench press stand, comprising:

(a) lying supine on the support board of a bench press stand, with one's head towards a head end of the bench press stand, and one's legs hanging down on opposite sides near a foot end of the bench press stand and a barbell with its bar resting in an overhead cradle of the bench press stand;

(b) providing and resting centered left-to-right on one's chest, the upper panel of an extrication device which includes:

an upper panel arranged to be supported generally horizontally and centrally in a left-to-right sense on the lifter's chest while the lifter is bench pressing a barbell using both hands, the upper panel said lower panel being of sufficient length as to extend across a lifter's groin area; being sufficiently stiff and of a sufficient size that, were the user to rest the barbell on the user's chest, the barbell's weight would be more evenly spread out over the user's torso than if the user were to rest the barbell directly on their chest;

a lower panel connected along an upper end thereof to a lower end of said upper panel so that the lower panel extends at a desired obtuse frontal angle to the upper panel, about a transverse, horizontal bend axis; and a support pedestal connected at one end to the lower panel distally of said upper end of said lower panel, centered in a left-to-right sense relative to said lower panel, and projecting rearwards at an obtuse angle to said lower panel; said support pedestal being of sufficient length as to engage the support board of the bench press stand, between the lifter's thighs, upon rotation of the device about said bend axis as the barbell, while resting on the upper panel, is progressively urged to proximity with said bend axis and beyond, onto said lower panel;

(c) raising the barbell, using two hands on the bar, from the cradle and performing at least one repetition of a supine bench press;

(d) upon being temporarily unable to raise the barbell enough to place it back into the cradle, (i) lowering the bar onto the upper panel, (ii) shifting the bar down into the bend between the upper and lower panels, and beyond, slightly onto the lower panel, and thereby causing the device to rotate about this bend until the support pedestal engages the support board of the bench press stand, thereby transferring much of the weight of the barbell from one's self to the support board of the bench press stand, (iii) sitting up, engaging the floor beside the bench press stand with one's feet, using one's chest to push forwards on the upper end of the upper panel of the device, backing up and thereby extricating one's self rearwardly under and behind the device and thereby from the barbell, leaving the barbell supported in the bend between the upper and lower panels of the device, on the support board of the bench press stand.

* * * * *